US006686820B1

(12) United States Patent
Ma et al.

(10) Patent No.: US 6,686,820 B1
(45) Date of Patent: Feb. 3, 2004

(54) MICROELECTROMECHANICAL (MEMS) SWITCHING APPARATUS

(75) Inventors: Qing Ma, San Jose, CA (US); Valluri Rao, Saratoga, CA (US); John Heck, Mtn View, CA (US); Li-Peng Wang, Santa Clara, CA (US); Dong Shim, Framingham, MA (US); Quan Tran, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 4 days.

(21) Appl. No.: 10/194,096

(22) Filed: Jul. 11, 2002

(51) Int. Cl.[7] ..... H01P 1/10
(52) U.S. Cl. ..... 333/262; 333/258
(58) Field of Search ..... 333/262, 258

(56) References Cited

U.S. PATENT DOCUMENTS 4,959,515 A 9/1990 Zavracky et al.
5,258,591 A 11/1993 Buck
5,334,809 A 8/1994 DiFrancesco
5,627,396 A 5/1997 James et al.
5,638,946 A 6/1997 Zavracky
5,673,785 A 10/1997 Schlaak et al.
5,677,823 A 10/1997 Smith
6,191,671 B1 2/2001 Schlaak et al.
6,196,738 B1 3/2001 Shimizu et al.
6,384,353 B1 5/2002 Huang et al.
6,396,368 B1 5/2002 Chow et al.
6,440,767 B1 8/2002 Loo et al.
6,452,124 B1 9/2002 York et al.

*Primary Examiner*—Don Le
(74) *Attorney, Agent, or Firm*—Glen Choi

(57) ABSTRACT

This application discloses a microelectromechanical (MEMS) switch apparatus comprising an anchor attached to a substrate and an electrically conductive beam attached to the anchor and in electrical contact therewith. The beam comprises a tapered portion having a proximal end and a distal end, the proximal end being attached to the anchor, an actuation portion attached to the distal end of the tapered portion, a tip attached to the actuation portion, the tip having a contact dimple thereon. The switch apparatus also includes an actuation electrode attached to the substrate and positioned between the actuation portion and the substrate. Additional embodiments are also described and claimed.

48 Claims, 13 Drawing Sheets

MICROELECTROMECHANICAL (MEMS) SWITCHING APPARATUS

TECHNICAL FIELD

This disclosure relates generally to microelectromechanical (MEMS) devices, and in particular, but not exclusively, relates to MEMS switching apparatus.

BACKGROUND

The use of microelectromechanical (MEMS) switches has been found to be advantageous over traditional solid-state switches. For example, MEMS switches have been found to have superior power efficiency, low insertion loss, and excellent electrical isolation. However, for certain high-speed applications such as RF transmission/receiving, MEMS switches are in general too slow. This is primarily due to the speed of a MEMS switch being limited by its resonance frequency. To improve the speed of the MEMS switch, the stiffness of the MEMS structure must be increased. However, stiff structures require higher actuation voltages for the switching action to occur.

Current MEMS switches, although functional, do not provide optimum performance because they are not mechanically optimized. Moreover, the lack of mechanical optimization in existing switches means that the switches tend to fail more rapidly. The lack of optimization also leads to degraded performance not only in measures such as switching speed and efficiency, but also in more corollary measures such as the actuation voltage of the switch.

One possible solution is to simply reduce the gap between the structure and the actuation electrode. This is problematical, however, due to degraded electrical isolation arising from coupling between the switch and the electrode. Additionally, the small gap between the structure and the actuation electrode has led to stiction problems between the structure and the electrode.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

Embodiments of a MEMS switching apparatus are described herein. In the following description, numerous specific details are described to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in this specification do not necessarily all refer to the same embodiment. Furthermore, the particular features, structures, or characteristics may be combined in any suitable manner in one or more embodiments.

Figure 1A:
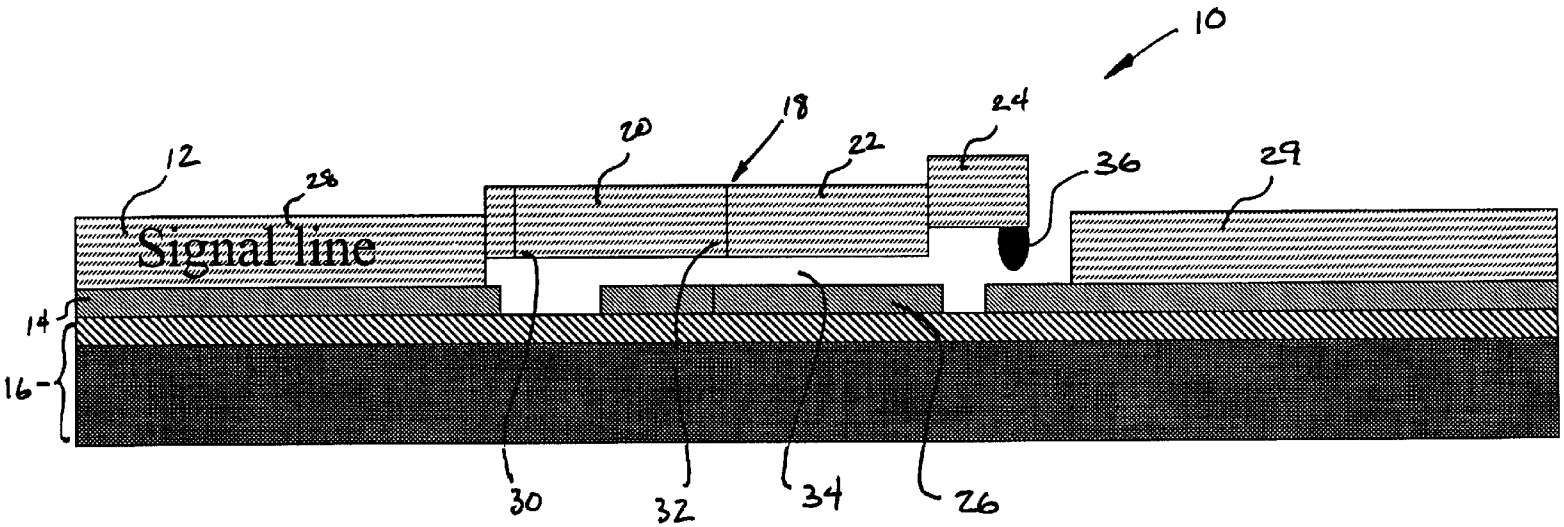
FIGS. 1A and 1B are a side view and a plan view, respectively, of a first embodiment of a series switch.
Figure 1B:
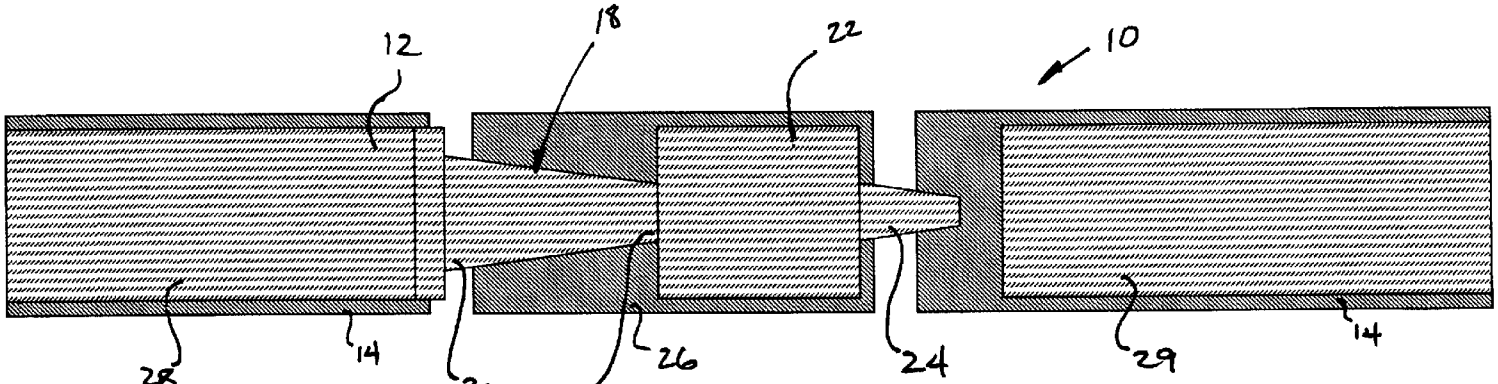

FIGS. 1A and 1B together illustrate a first embodiment of the invention comprising a microelectromechanical (MEMS) cantilever series switch 10. The series switch 10 comprises an anchor 12 mounted to a dielectric pad 14 attached to a substrate 16, and a cantilever beam 18 that includes a tapered portion 20, an actuation portion 22, and a tip 24. An actuation electrode 26 is mounted to the substrate 16 and positioned between the actuation portion 22 of the beam and the substrate 16.

The anchor 12 is firmly attached to a dielectric pad 14 positioned on the substrate 16. As its name implies, the anchor provides a firm mechanical connection between the beam 18 and the substrate, as well as providing a rigid structure from which the beam is cantilevered, and providing electrical connection between the beam and the substrate. In the embodiment shown, the anchor 12 is itself a first portion 28 of a signal line carrying some form of electrical signal. The anchor is thus made of an electrically conductive material to allow it to carry the signal and transmit it into the beam 18 during operation of the switch. The substrate 16 can, for example, be some sort of semiconductor wafer or some portion thereof comprising various layers of different semiconducting material, such as polysilicon, single crystal silicon, etc, although the particular construction of the substrate is not important to the construction or function of the apparatus described herein.

The tapered portion 20 of the beam includes a proximal end 30 and a distal end 32. The proximal end 30 is attached to the anchor 12, while the distal end 32 is attached to the actuation portion 22. The tapered portion 20 of the beam is vertically offset relative to the anchor 12 to provide the needed space 34 between the actuation portion 22 and the actuation electrode 26. The tapered portion 20 of the beam is preferably relatively thick (approximately 6 $\mu$m) and is preferably made of a highly conductive material such as gold (Au), although in other embodiments it can be made of other materials or combinations of materials, or can have a composite construction. The gap 34 between the actuation electrode 26 and the actuation portion of the beam is preferably small, on the order of 5 $\mu$m, although in other embodiments a greater or lesser gap can be used.

The actuation portion 22 is mounted to the distal end 32 of the tapered portion 20 of the beam. The actuation portion 22 is relatively wide compared to the tapered portion 20, to provide a greater area over which the force applied by the activation of the actuation electrode 26 can act. In other words, since actuation force is proportional to the area of the actuation portion 22, the wider and longer actuation portion 22 of the beam causes a larger force to be applied to the beam when the actuation electrode 26 is activated. This results in faster switch response. Like the tapered portion 20, the actuation portion 22 is also preferably made of some highly conductive material such as gold, although in other embodiments it can be made of other materials or combinations of materials, or can have a composite construction.

A tip 24 is attached to the actuation portion 22 of the beam opposite from where the tapered portion 20 is attached. On the lower side of the tip 24 there is a contact dimple 36, whose function is to make contact with the electrode 29 when the cantilever beam 18 deflects in response to a charge applied to the actuation electrode 26. The tip 24 is vertically offset from the actuation area, much like the tapered portion 20 is offset vertically from the anchor 12. This vertical offset of the tip 24 relative to the actuation area 22 reduces capacitative coupling between the beam 18 and the second portion 29 of the signal line.

In operation of the switch 10, the anchor 12 is in electrical contact with, and forms part of, a first portion 28 of a signal line carrying an electrical signal. Opposite the first portion 28 of the signal line is a second portion 29 of the signal line. To activate the switch 10 and make the signal line continuous, such that a signal traveling down the first portion 28 of the signal line will travel through the switch 10 and into the second portion 29 of the signal line, the actuation electrode 26 is activated by inducing a charge in it. When the actuation electrode 26 becomes electrically charged, because of the small gap between the actuation electrode and the actuation portion 22 of the beam, the actuation portion of the beam will be drawn toward the electrode. When this happens, the beam 18 deflects downward, bringing the contact dimple 36 in contact with the second electrode 29, thus completing the signal line and allowing a signal to pass from the first portion 28 of the signal line to the second portion 29 of the signal line.

Figure 2A:
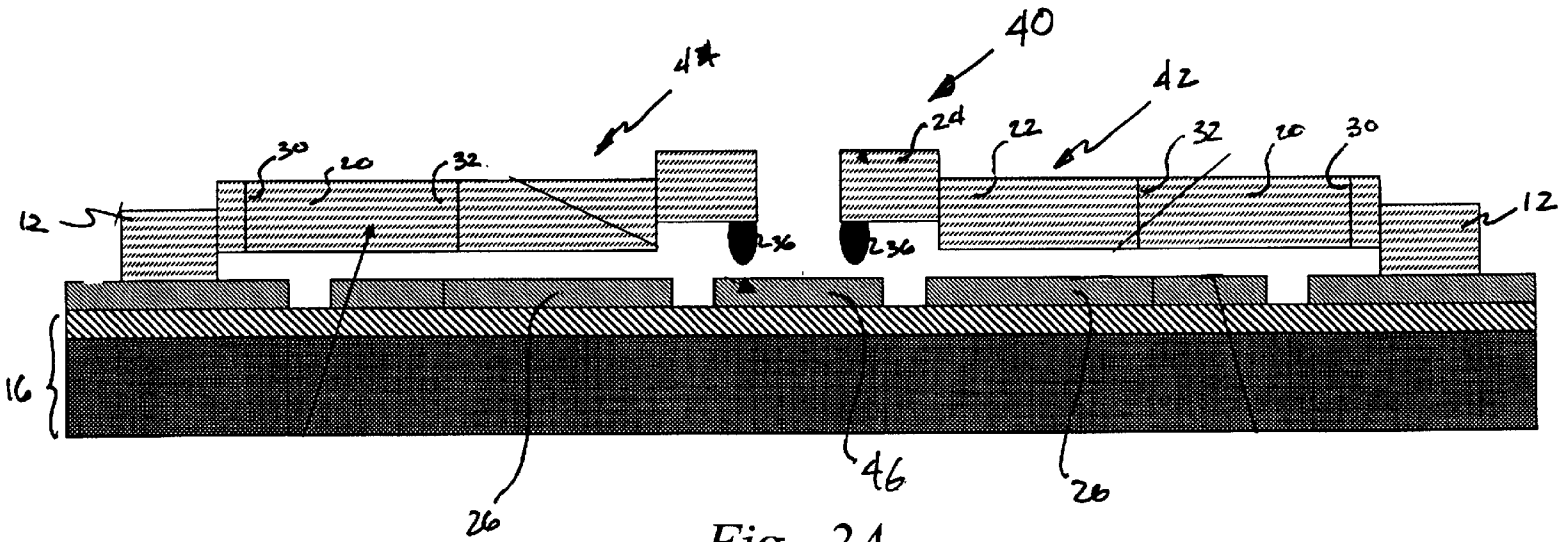
FIGS. 2A and 2B are a side view and a plan view, respectively, of an embodiment of a shunt switch.
Figure 2B:
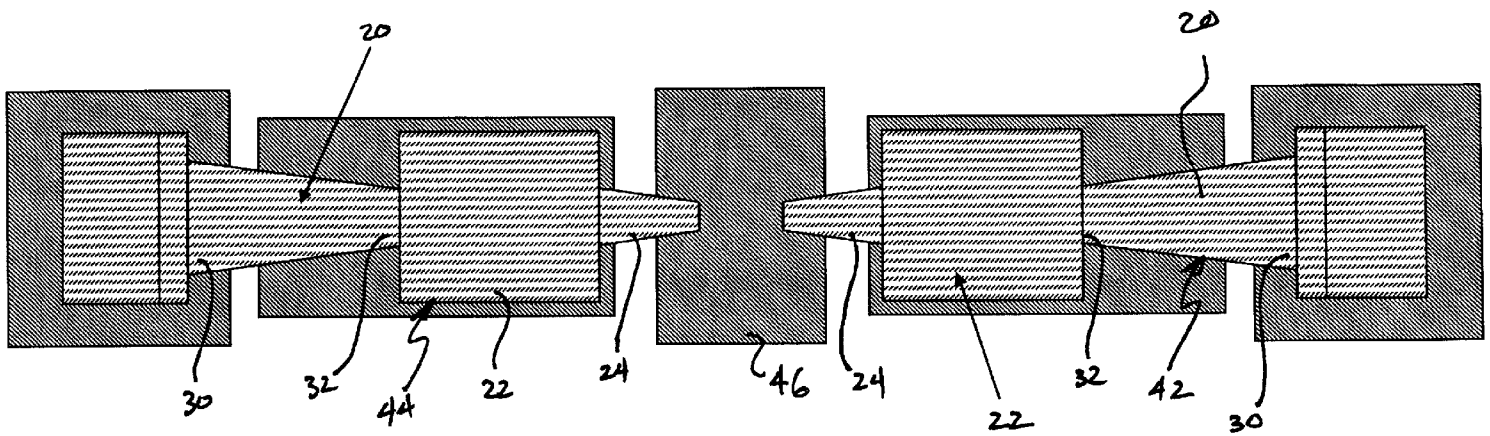

FIGS. 2A and 2B illustrate another embodiment of the invention comprising a shunt switch 40. The shunt switch 40 includes a pair of cantilever beam switch elements 42 and 44, symmetrically positioned about a signal line 46, although in other embodiments the beam elements 42 and 44 need not be symmetrically positioned about the signal line or, in other cases, only one beam element may be needed for shunting.

Each of the cantilever beams 42 and 44 in the shunt switch 40 has a construction similar to the beam described in connection with FIG. 1A: each beam includes an anchor 12 attached to the substrate 16 and a beam attached to the anchor. Each beam 42 and 44 comprises a tapered portion 20, an actuation portion 22, and a tip 24, on one side of which is a contact dimple 36. As before, the tapered portion comprises a proximal end 30 connected to the anchor, and a distal end 32 connected to an actuation portion 22. The tip 24 is connected to the actuation portion 22 opposite where the distal end of the tapered portion is connected, and has a contact dimple 36 on the lower portion thereof to enable it to make electrical contact with the signal line 46. Since the switch 40 is a shunt switch, each of the anchors 12 are connected to a ground, such as a radio frequency (RF) ground.

In operation of the shunt switch 40, to shunt the signal traveling through the signal line 46, a current is passed through both actuation electrodes 26 simultaneously to induce an electrical charge therein. The induced charge in the actuation electrodes 26 creates a force drawing the actuation portions 22 of the beams 42 and 44 toward the electrodes, thus drawing the tips towards the substrate, and causing both contact dimples 36 to come into contact with the signal line 46. When the contact dimples contact the signal line, the signal traveling through the signal line 46 is shunted to the RF grounds through the beams 42 and 44 and the anchors 12 to which the beams are electrically connected.

The series switch 10 and shunt switch 40 have several advantages. First, they are simple structures with a thick gold beam (preferably about 6 $\mu$m in thickness) which provides it with stability. A gold beam is generally not mechanically stable. When heated, it can deform by creep and can easily deform plastically. To gain sufficient stability for long term applications, the beam has to be at least 6 $\mu$m thick. Second, the switch using the beam as shown is a very simple one to construct; as will be seen later, only 5 masks are needed. Next the small gap between the actuation portion 22 of the beam and the actuation electrode 26 (approximately 5 $\mu$m) allows for very low actuation voltages. Because the thick beam is very stiff, it is relatively easy to fabricate the device with a small gap, and there are no stiction problems. The actuation force is inversely proportional to gap size, so lower actuation voltage is needed for smaller gaps. Next, the actuation portion 22 of the beam is widened to provide for low actuation force. Since the actuation force is proportional to the actuation area, this provides for very low actuation voltages needed to actuate the beam. Next, the beam is tapered to produce uniform stress/strain distribution along the beam. Because the bending moment at any point along the beam is proportional to the distance to the exerting point of force, the moment is maximum near the anchor. For rectangular beams, the highest stress is near the anchor. This is undesirable because concentrated stress can cause local plastic deformation and more importantly the mechanical response is very sensitive to any slight variation of the anchor. Using tapered beams, the stress/deformation is evenly distributed along the beam, making the mechanical characteristics more consistent. Finally, the raised/narrowed tip for reducing the beam/transmission line capacitative coupling and for reducing mass. This reduces the undesirable capacitative coupling between the beam and the transmission line when the beam is in its up position. In addition, by making the tip narrow, the overall mass of the beam is reduced and thus improves switching speed.

Figure 3A:
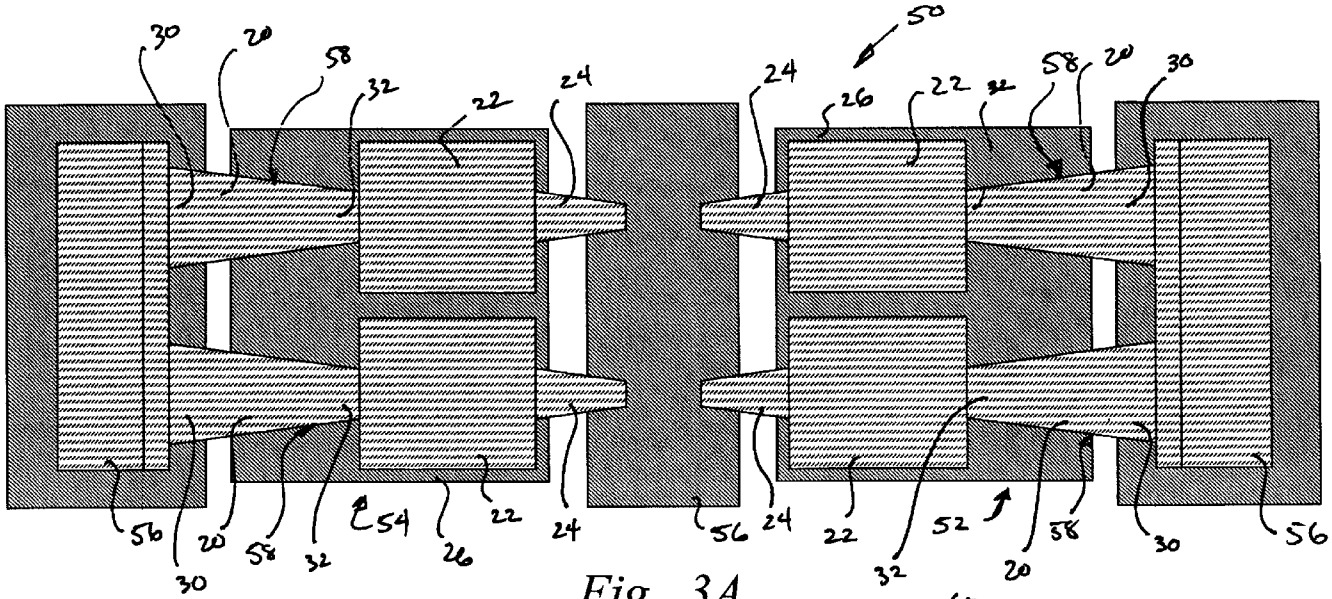
FIG. 3A is a plan view of an embodiment of a shunt switch incorporating two beam arrays.

FIG. 3A illustrates an alternative embodiment of a shunt switch 50 including a pair of beam arrays 52 and 54 symmetrically positioned about a signal line 56. Sometimes, more than one switch or one beam element is needed to handle the current or to provide enough isolation. In other embodiments, however, the beam arrays need not be symmetrically positioned about the signal line 56, and only one beam array can be used instead of two. Each beam array 52 and 54 includes an anchor 56 attached to a substrate, and in electrical contact therewith. Each anchor 56 is attached to some sort of ground, such as a radio frequency (RF) ground. Connected to each anchor 56 are a pair of beams 58 having a similar construction to the beam shown in FIG. 1A: each beam 58 comprises a tapered portion 20, an actuation portion 22, and a tip portion 24. As in previous embodiments, the tapered portion 20 comprises a proximal end 30 attached to the anchor 56, and a distal end 32 connected to the actuation portion 22. On the side of the actuation portion 22 opposite where the distal end 32 is attached, a tip 24 is attached. Each tip 24 has a contact dimple on its lower side (see FIG. 1A) used to make contact with a signal line 56. Between each actuation portion 22 and the substrate, there is an actuation electrode 26 which, when electrically charged, exerts and attractive force on the actuation portion 22 of each beam. As before, the tapered portion 20 of each beam is vertically offset from the anchor 56 to provide a gap between the actuation portion 22 of the beam and the actuation electrode 26 mounted on the substrate below it. Similarly, the tips 24 are vertically offset from the actuation portions to reduce or eliminate capacitative coupling when the beam is in its raised position.

The operation of the shunt switch 50 is similar to that of the shunt switch 40 (see FIG. 2A). To shunt the current traveling through the signal line 56, the actuation electrodes 26 are electrically charged, thus drawing the actuation portion of each beam 58 toward the actuation electrode. When this happens, the contact dimples at the ends of the tips are lowered and come into contact with the signal line 56. In the embodiment shown, the switches are mechanically independent, which insures that all contact dimples on the tips 24 have good contact with the signal line 56.

Figure 3B:
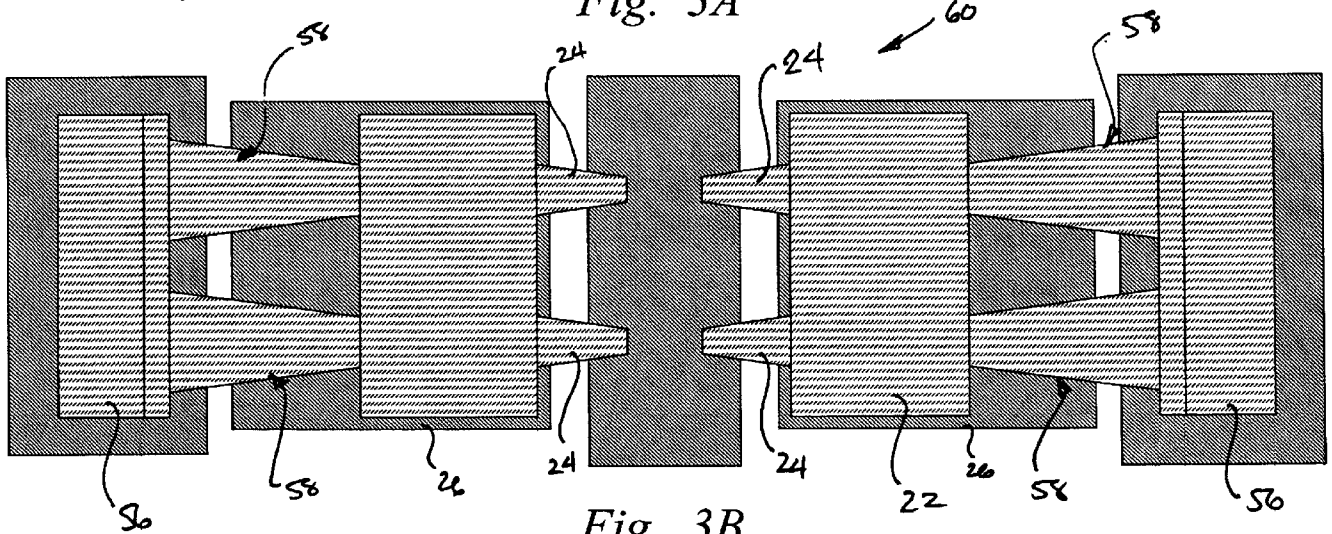
FIG. 3B is a plan view of an embodiment of a shunt switch incorporating two beam arrays having their actuation portions joined together.

FIG. 3B illustrates another embodiment of a shunt switch 60 that is a variation of the shunt switch 50 shown in FIG. 3A. The construction and operation of the elements of the shunt switch 60 are similar to those of the shunt switch 50, except that in the shunt switch 60 the beams are mechanically joined by connecting the actuation portions 22 of adjacent beams. Joining together the actuation portion of the beams provide stability against tilting to one side, which could happen if a gap on one side is slightly smaller than the other so that the electrostatic force is exerted by the actuation electrode on the actuation portion of the beam is not balanced. Because this structure has relatively high flexibility, good contact can be achieved as well.

Figure 4:
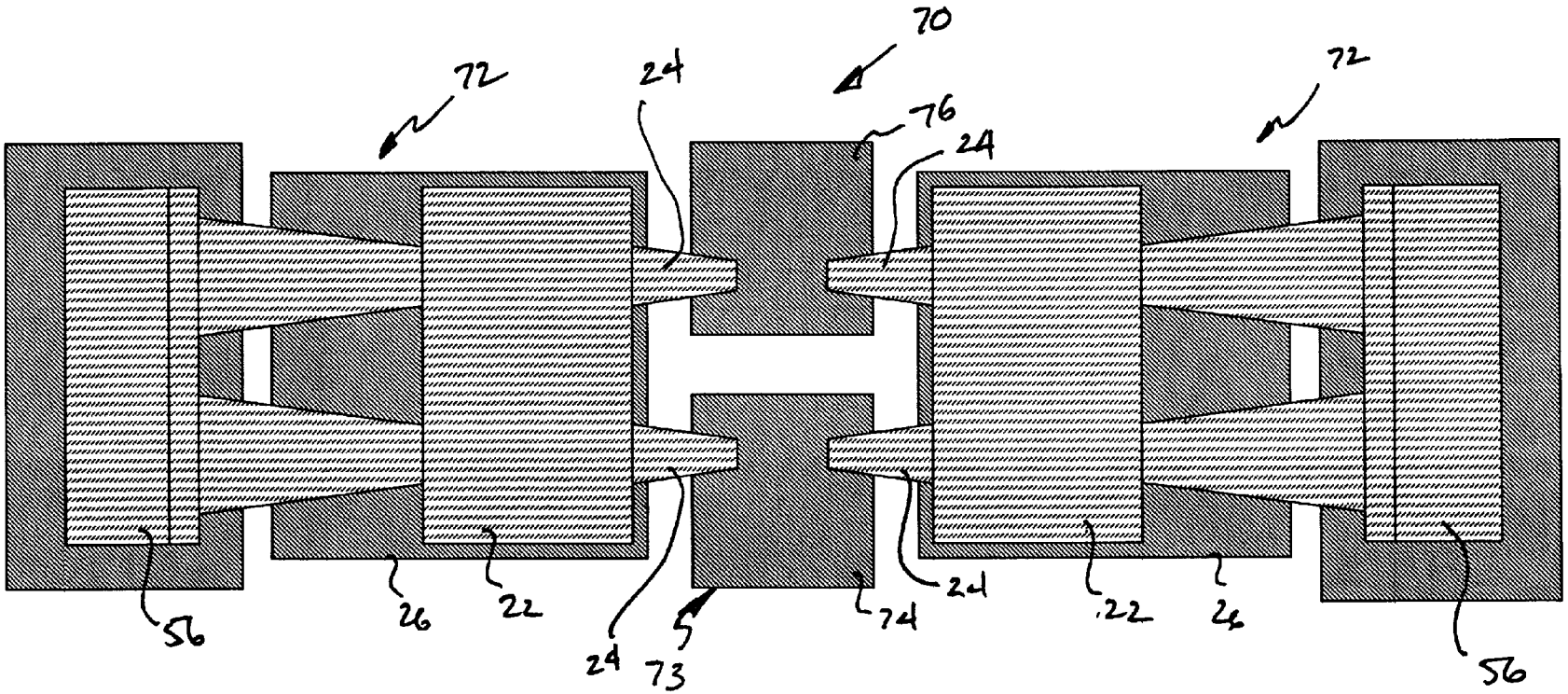
FIG. 4 is a plan view of an embodiment of a series switch incorporating a pair of beam arrays having their actuation portions joined together.

FIG. 4A illustrates an embodiment of a series switch 70 that uses a pair of beam arrays 72 similar to those shown in FIG. 3B. The beam arrays 72 in the switch 70 are similar in construction of those used in the shunt switch 50. As in the switch 50 a pair of beam arrays is symmetrically positioned about a signal line 73, although in other embodiments the beam arrays 72 need not be symmetrically positioned about the signal line or, in other cases, only one beam array 72 may be needed to make the connection. In this series switch 70, however, the signal line 73 is not continuous but rather consists of a first portion 74 which is electrically insulated from a second portion 76. Moreover, in the series switch 70, the anchors 56 are not connected to ground, but instead are electrically insulated from the substrate so that current cannot travel through them to the substrate.

In operation of the series switch 70, to make electrical contact between the first portion 74 and the second portion 76 of the signal line, the actuation electrodes 26 positioned between the actuation portions 22 of the beam arrays and the substrate are activated, thus drawing the actuation portions 22 of the beams toward it. When this happens, the contact dimples on the tips 24 of each beam array come in contact with both the first portion 74 and the second portion 76. The first portion and the second portion were previously electrically insulated from each other, but when the contact dimples from the beam arrays 72 come into contact with the first and second portions, an electrical connection is made between the first portion and second portion, thus allowing a signal to travel through the signal line.

Figure 5A:
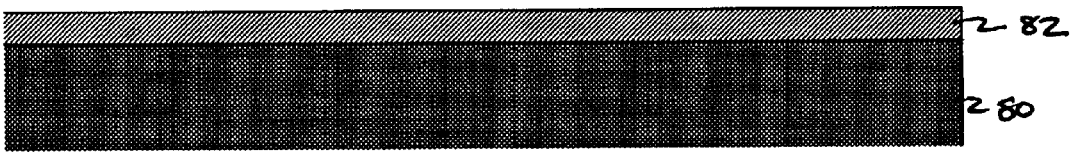
FIGS. 5A through 5J are drawings of an embodiment of a process used to create a switch such as that shown in FIG. 1A.
Figure 5B:
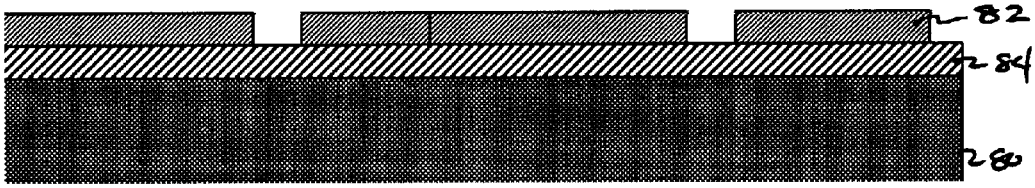
Figure 5C:
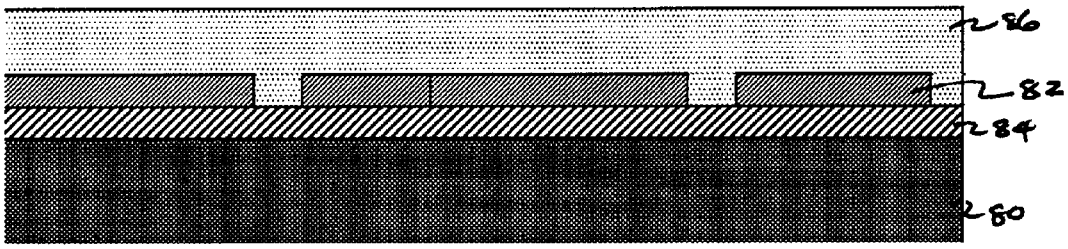

FIGS. 5A through 5J illustrate an embodiment of a process by which a switch such as the switch 10 (see FIG. 1A) is built. The process for multiple beams, or for beam arrays, is an extension of the process shown. FIGS. 5A through 5C illustrate the preliminary steps. In FIG. 5A, one or more dielectric layers 82, for example silicon dioxide ($SiO_2$) or silicon nitride (SiN), are deposited on an underlying layer 80 to form a substrate. In FIG. 5B, a bottom metal layer 84 such as titanium (Ti), nickel (Ni), or gold (Au) is deposited and patterned underneath the dielectric layers 82. In FIG. 5C, a sacrificial layer 86 (e.g., polysilicon) is deposited and spun on top of the bottom metal layer 84 and the dielectric layer 82.

Figure 5D:
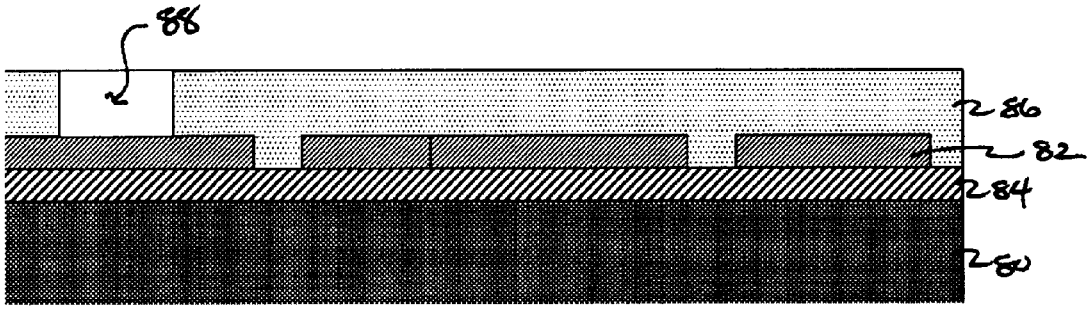
Figure 5E:
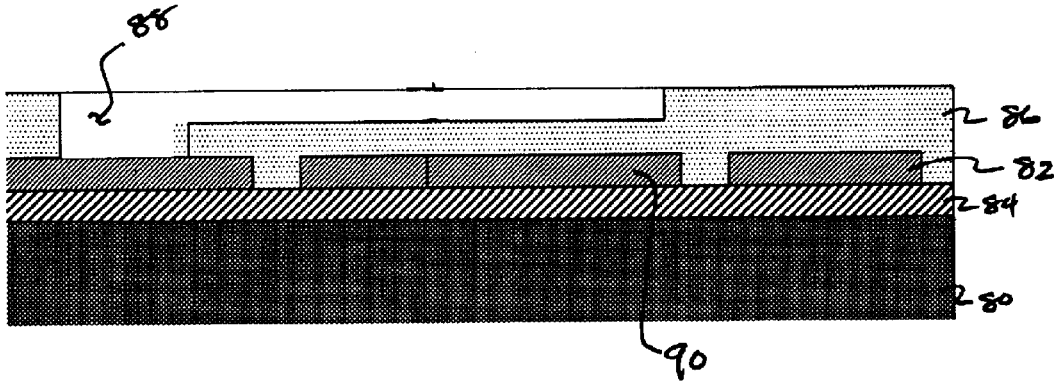
Figure 5F:
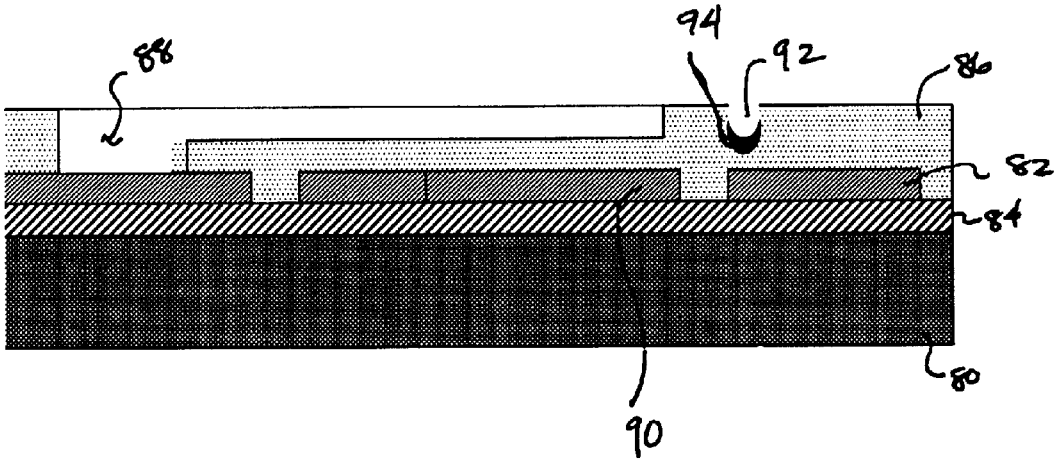
Figure 5G:
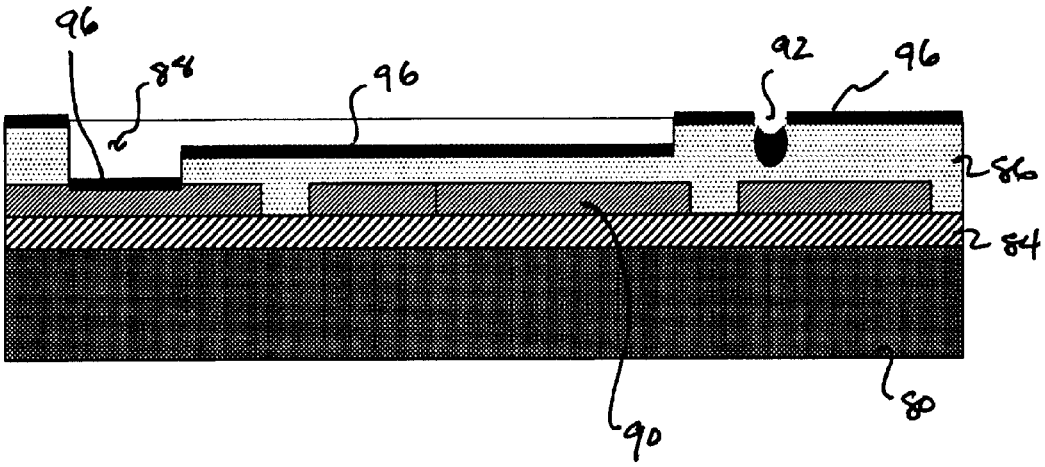
Figure 5H:
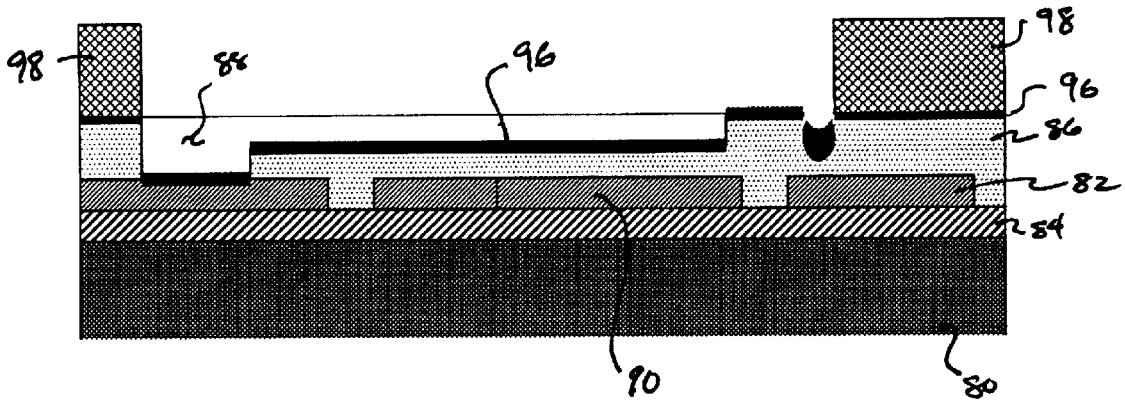
Figure 5I:
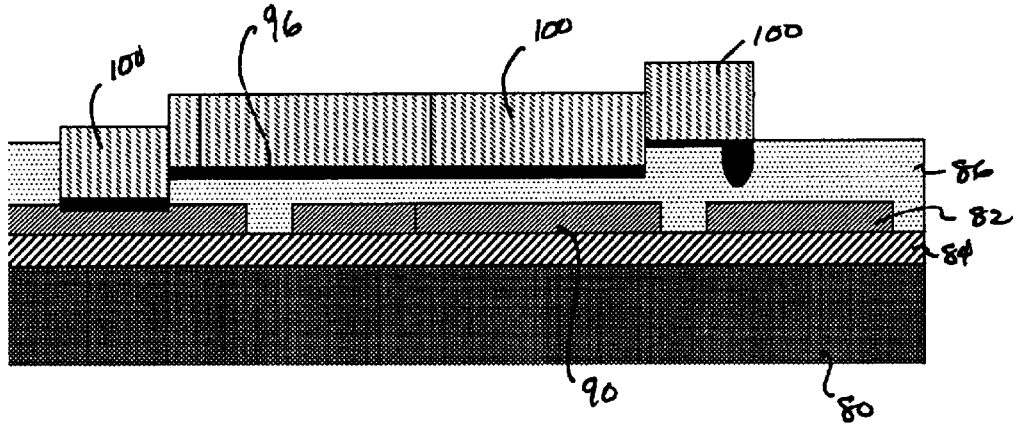
Figure 5J:
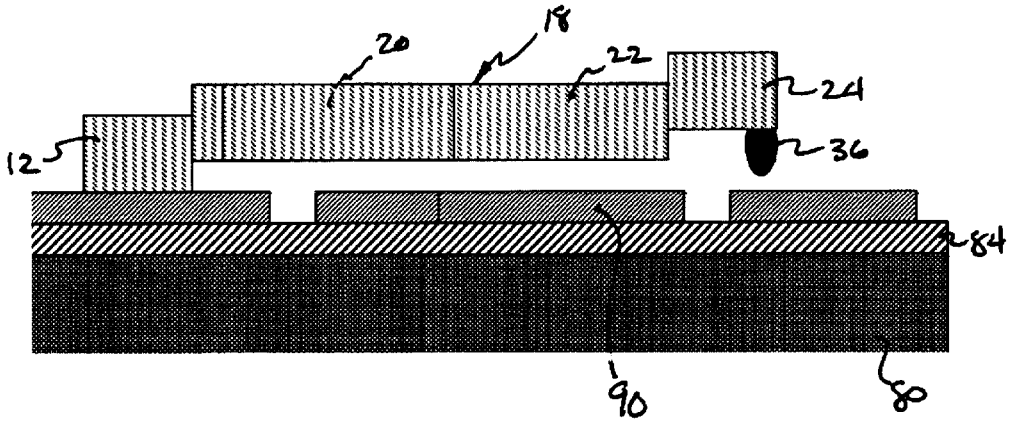

FIGS. 5D through 5J illustrate the construction of the elements comprising the switch. In FIG. 5D, an anchor hole 88 is lithographed and etched into the sacrificial layer 86. In FIG. 5E, the sacrificial layer 86 is lithographed and time etched to define what will later become the gap between the actuation electrode 40 and the actuation portion of the beam. In FIG. 5F, what will later become the contact dimple is lithographed and etched into the sacrificial layer 86 to create a dimple hole 92, and a lift off dimple alloy material 94, such as gold titanium (Au-Ti) or aluminum chromium (Au-Cr), is used. In FIG. 5G, a seed layer 96 is directionally deposited over the etched sacrificial layer 86. The seed layer is, for example, titanium. In FIG. 5H, a thick layer of photoresist 98 is patterned onto the seed layer to act as a mold for the creation of the elements of the beam. In FIG. 51, a layer of gold or other material 100 of which the beam is formed, is plated onto the top of the seed layer 96, and the photoresist 98 is stripped away, and the uncovered seed layer 96 is etched away. Finally, in FIG. 5J, the sacrificial layer 86 is removed through etching to release the beam 18.

Figure 6A:
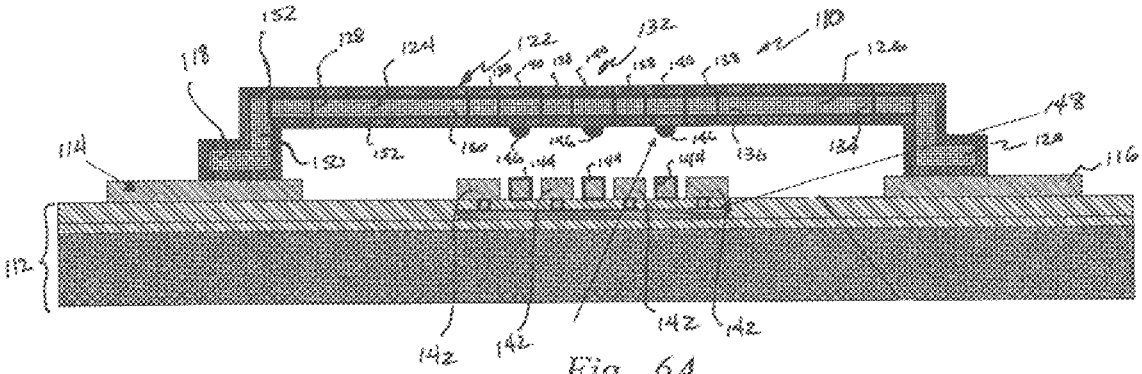
FIGS. 6A and 6B illustrate a side view and a plan view, respectively, of an embodiment of a composite beam shunt switch.
Figure 6B:
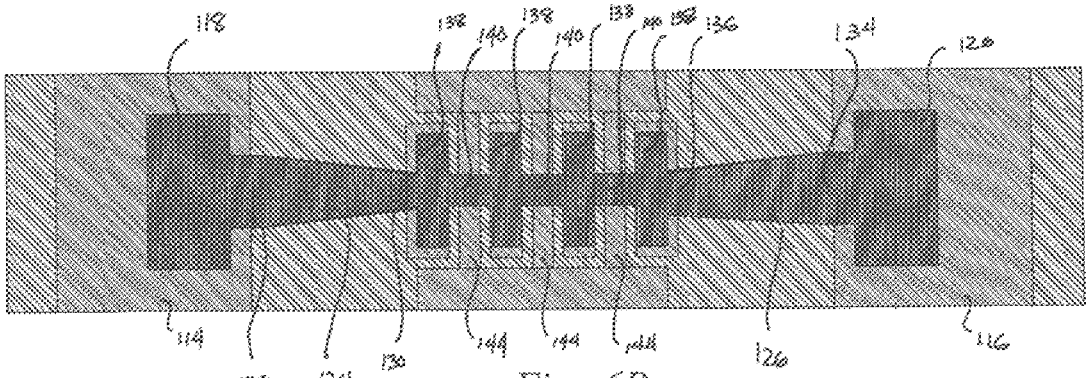

FIGS. 6A and 6B illustrate an embodiment of the invention comprising a composite beam shunt switch 110. The shunt switch 110 is positioned atop a substrate 112, which in this embodiment comprises one or more layers of semiconducting material. Positioned on the substrate are dielectric pads 114 and 116, to which are attached a pair of anchors 118 and 120. The beam 122 is physically and electrically connected to, and extends between, the first anchor 118 and the second anchor 12. The beam 122 comprises a first tapering portion 124 and a second tapering portion 126. The first tapering portion 124 has proximal end 128 attached to the first anchor 118, and a distal end 130 attached to a middle portion 132 of the beam. Similarly, the second tapered portion 126 has a proximal end 134 attached to the second anchor 120, and a distal end 136 also connected to the middle portion 132 of the beam.

The middle portion 132 of the beam comprises a plurality of alternating actuation portions 138 and contact portions 140; in the case shown, there are four actuation portions 138 and three contact portions 140 positioned between the four actuation portions. The actuation portions 138 are substantially wider than the contact portions to increase the area of the actuation portion positioned over the actuation electrodes 142; as previously explained, the larger area results in much lower actuation voltages. The contact portions 140, in contrast to the actuation portions 138, are narrowed to reduce up-state coupling and effective mass, and are positioned over a plurality of signal lines 144. Each contact portion has a contact dimple 146 on the side facing the substrate. The multiple dimples appearing on the multiple contact portions produce low contact resistance and improved reliability of the entire switch. The actuation electrodes 142 and signal lines 144 are positioned over a low conductivity layer 148 embedded in the substrate to produce low radio frequency (RF) scattering.

The beam 122, including the tapered portions 124 and 126 and the bridge portion 132, are of a composite construction. In one embodiment, the composite construction comprises a layer of structural material 150 sandwiched by two thin layers 152 of a highly conductive metal. The structural materials can be silicon nitride (SiN), silicon carbide (SiC), titanium (Ti), chromium (Cr), or nickel (Ni); all have much higher stiffness-to-density ratio than gold, for example. The two thin layers of highly conductive metal are preferably gold (AU) but can be other highly conductive metals as well, such as silver, copper, and the like. The composite construction of the beam helps to insure a high overall stiffness to density ratio, which improves the speed of the switch.

In operation of the switch 110, when the beam is in its inactivated state as shown no shunting takes place. When shunting is desired, a charge is induced in the actuation electrodes 142. Once charged, the actuation electrodes create an electrostatic force which draws the actuation portions 138 of the bridge toward the actuation electrodes, which in turn causes the contact dimples 146 to contact the signal lines 144. Both anchors 118 and 120 are connected to ground through the dielectric pads 114 and 116 to which they are attached. Thus, when the contact dimples 146 contact the signal lines 144, current traveling through the signal lines is shunted to ground through the conductive layers 152 of the beam.

Switches incorporating a composite beam, such as the beam 122, have several advantages. First, the composite beam with the structural material means that the beam can better resist inelastic deformation such as plastic flow and creep due to heating. A regular gold beam by itself, would deform easily unless very thick. Moreover, the thin conductive layers on the top and bottom of the beam act to balance stress. Second, there are multiple dimples for low contact resistance and improved reliability. The electrical performance of the switch is mostly determined by the contact resistance. With multiple dimples that total resistance is reduced. Third, the top/bottom actuation electrode pair provide enhanced uniform pulling force and low actuation voltage. Because the width of the beam is greatly expanded above the actuation electrodes, the actuation voltage is reduced. This distributed electrode design also ensures good contact by the dimples because the actuation force surrounds the dimples. Next, the beam is tapered to produce uniform stress distribution along the beam. This reduces concentrated stress which can cause local plastic deformation, and more importantly reduces variation in the mechanical response due to slight variations of the anchor. By using tapered beams, the stress and deformation are evenly distributed along the beam, making the mechanical characteristics more consistent. Next, the contact portions above the transmission lines are narrowed to reduce up-state coupling and effective mass. By making these portions narrow mass is reduced, improving switching speed, and reducing undesirable capacitative coupling between the beam and the transmission line when the beam is in its up or inactivated position. Finally, the composite beam 122 provides a low conductivity layer for low RF scattering. The interconnects connecting to a DC source is made of low conductivity material such as polysilicon, so that it appears dielectric to radio frequency.

Figure 7A:
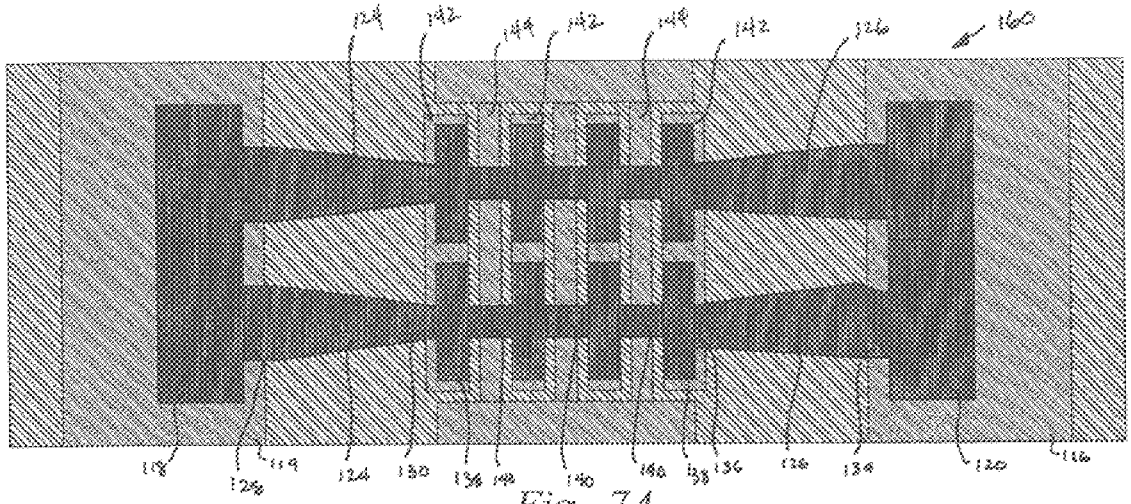
FIG. 7A is a plan view of an embodiment of a shunt switch incorporating an array of beams.

FIG. 7A illustrates a composite beam shunt switch array 160. This is a variation of the shunt switch shown in FIGS. 6A and 6B, and is useful for cases where more than one switch is necessary to handle a current, or where better isolation is necessary. This switch 160 comprises a first anchor 118 connected to the substrate by a pad of a dielectric material 114, and a second anchor 120 also connected to the substrate through a dielectric pad 116. Both dielectric pads 114 and 116 are connected to some sort of ground since this is a shunt switch. Extending between the first anchor 118 and the second anchor 120 are a pair of beams. Each of the beams is of a composite construction and has a similar structure to the beams illustrated in FIGS. 6A and 6B; both beams comprise of a first tapered portion 124, a second tapered portion 126, and a bridge section supported between the two tapered portions. As before, the bridge portion of the beam comprises alternating actuation portions 138 and contact portions 140, each contact portion having a contact dimple on the bottom side thereof. Positioned below the actuation portions 138 of the beam are actuation electrodes 142 which extend across the entire width of the actuation portions of both beams.

In operation, the beam shunt switch array 160 operates similarly to the shunt switch illustrated in FIG. 6A, except that when the actuation electrodes 142 are activated both beams are drawn towards the actuation electrodes, bringing the contact dimples on the contact portions 140 into contact with the signal lines 144. When the contact dimples make contact with the signal line, any current traveling through the signal line is shunted through the conductive materials on the exterior of the beams to the anchors, and through the dielectric pads 114 and 116 to ground. In the embodiment shown, the two beams are mechanically independent, which insures that all the dimples on the bottoms of the contact portions have good contact with the signal line.

Figure 7B:
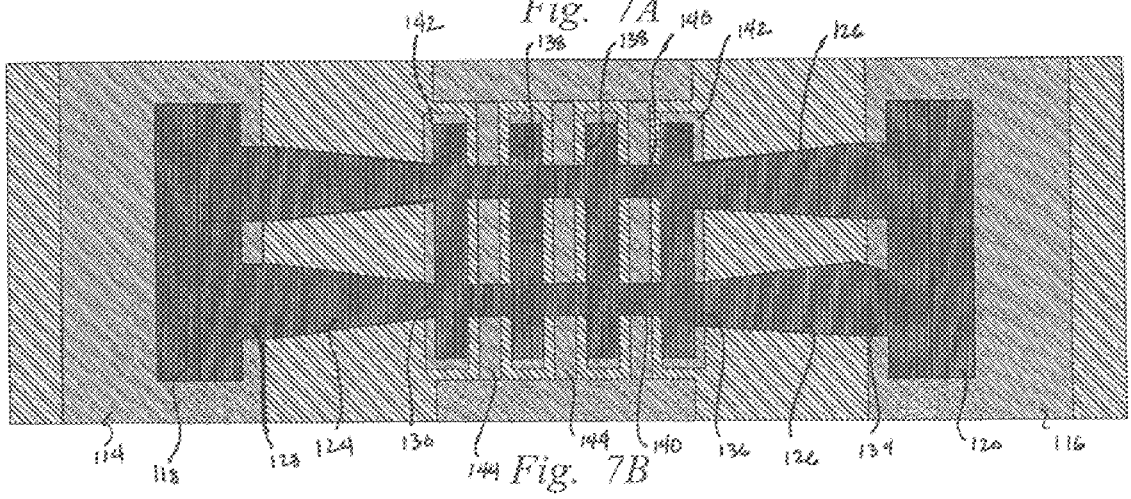
FIG. 7B is a plan view of an embodiment of a shunt switch that is a variation of the switch shown in FIG. 7A.

FIG. 7B illustrates an embodiment of a shunt switch 170 that is a variation of the shunt switch array 160 shown in FIG. 7A. The primary difference between the shunt switches 160 and 170 is that in the switch 170 the actuation portion of each beam is joined to the actuation portion of the adjacent beam. Joining the beams provides stability against tilting to one side, which can happen if the gap on one side between the actuation portion of the actuation electrode is slightly smaller than the other, so that the electrostatic force exerted on the actuation portion of the beam is not balanced. Because this structure has relatively high flexibility, it is expected that good contact can be achieved as well.

Figure 8A:
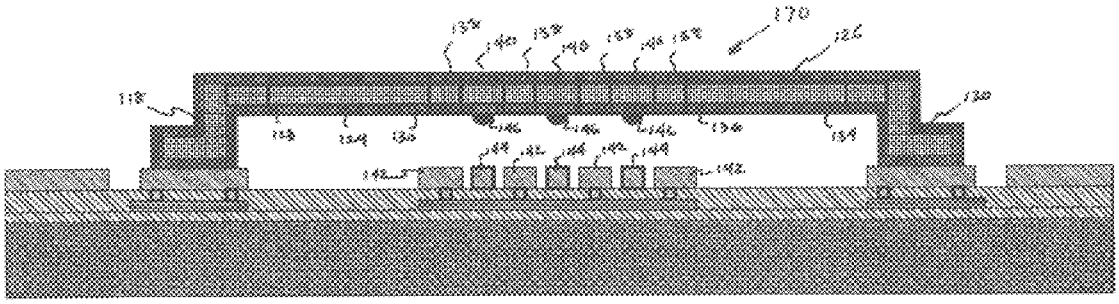
FIGS. 8A and 8B are a side view and a plan view, respectively, of an embodiment of a series switch using an array of composite beams.
Figure 8B:
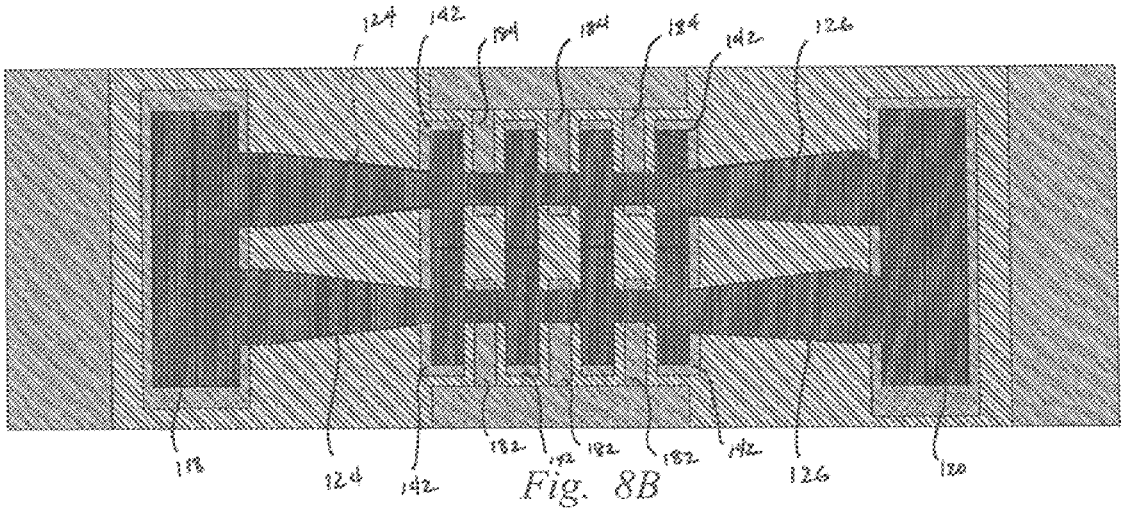

FIGS. 8A and 8B illustrate another embodiment of a composite beam series switch array 170. As with previous embodiments, the switch comprises a pair of composite beams positioned over a plurality of actuation electrodes 142 and a plurality of signal lines 144. In this embodiment, however, each signal line 144 is broken into first portions 182 which are electrically isolated from second portions 184. Also, whereas previously the anchors 118 and 120 were connected to a radio frequency (RF) ground so that the switch would function as a shunt switch, in this case the anchors 118 and 120 are electrically insulated, so that current will not travel from the signal lines into the substrate through the beams.

The operation of the series switch 170 is similar to the operation of the shunt switches previously described. When a charge is induced in the activation electrodes 142, the actuation portions of the beam are drawn towards them, thus drawing the dimples on the contact portions into contact with the signal lines 144; the contact dimples on the first beam will contact the first portions 182 of the signal line, and the contact dimples on the second beam will contact the second portion 184 of the signal line. Since the beams are mechanically and electrically connected to each other, current, and therefore the signal carried in the signal line, can flow from the first portion 182 of the signal line to the second portion 184 of the signal line. The beams are not shorted to RF ground, but instead to a DC source through a low conductivity interconnect. The low conductivity layer appears to be dielectric to radio frequency.

Figure 9A:
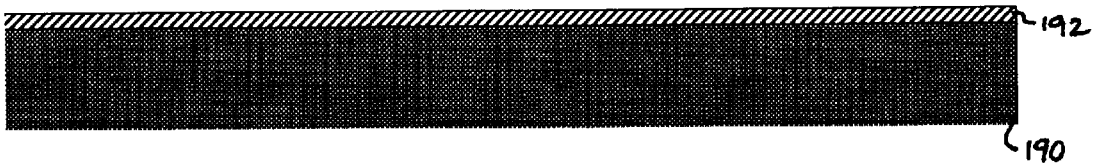
FIGS. 9A through 9J are drawings illustrating an embodiment of a process by which a composite beam such as that shown in FIG. 6A is constructed.
Figure 9B:
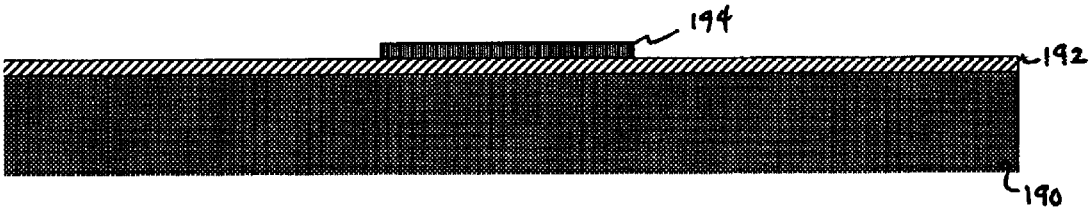
Figure 9C:
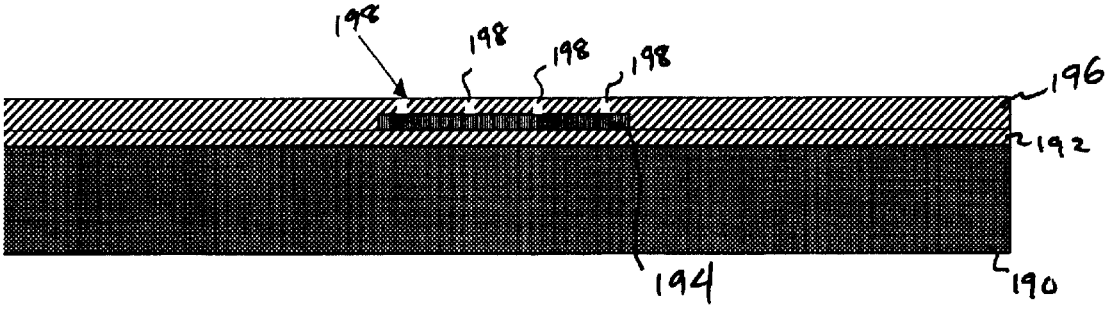
Figure 9D:
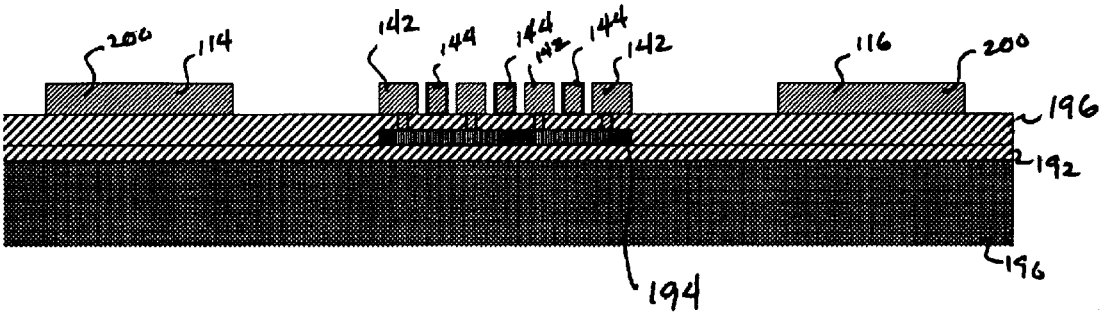
Figure 9E:
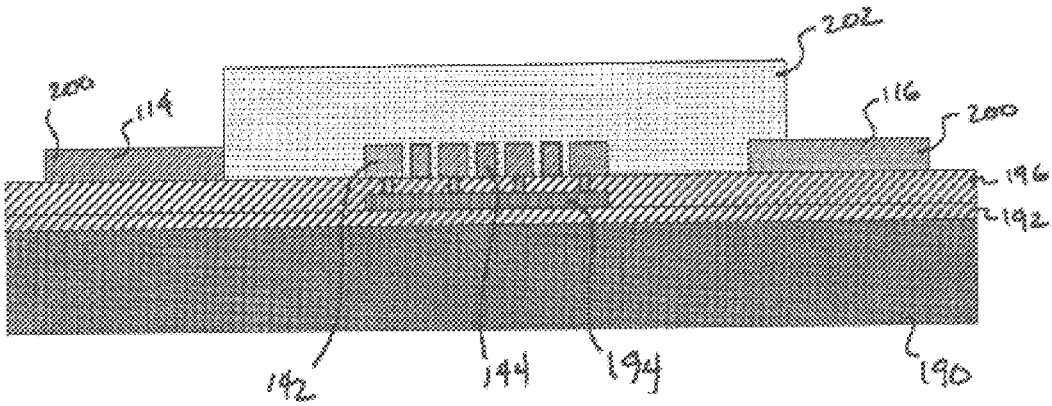
Figure 9F:
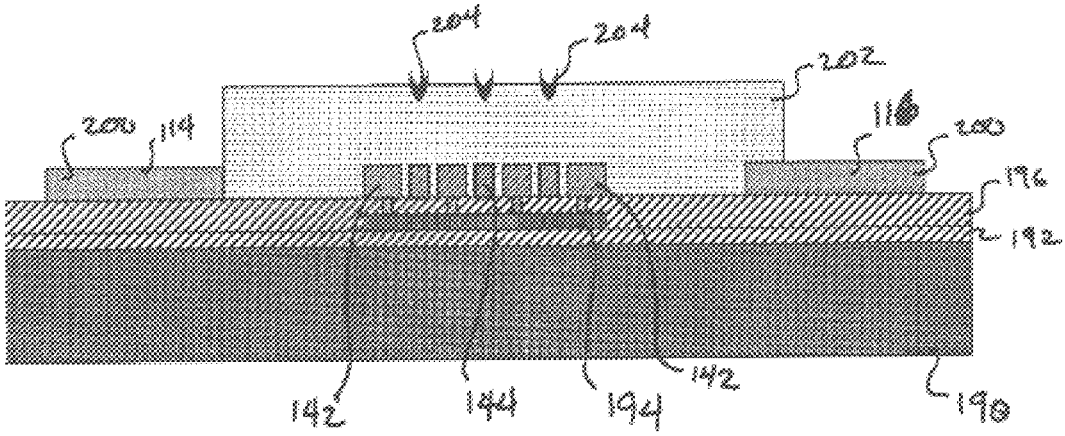
Figure 9G:
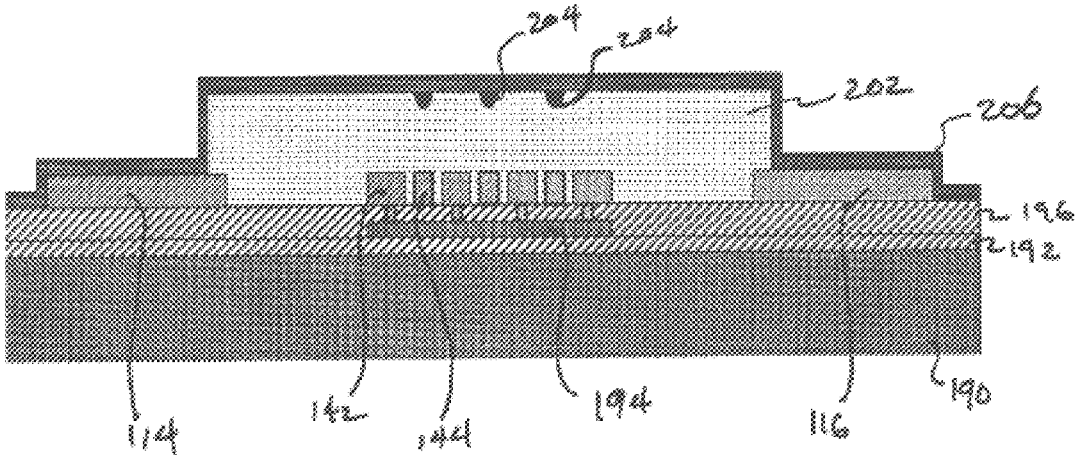
Figure 9H:
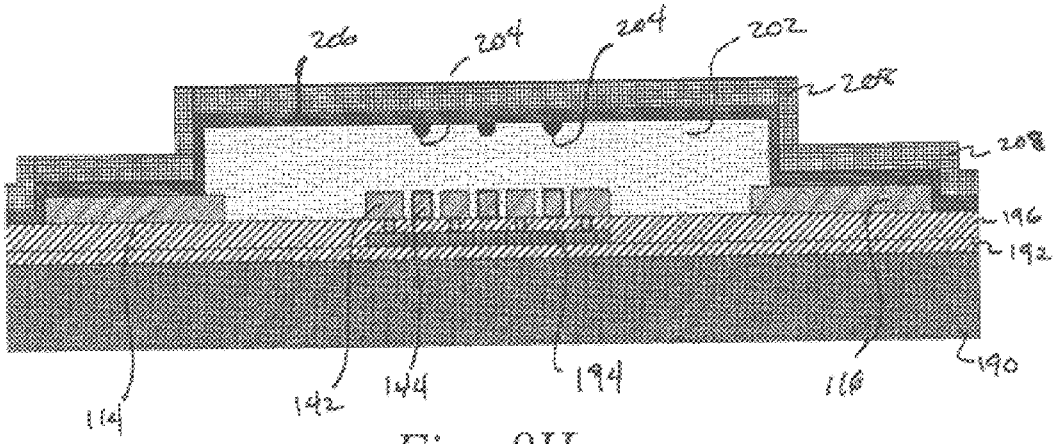
Figure 9I:
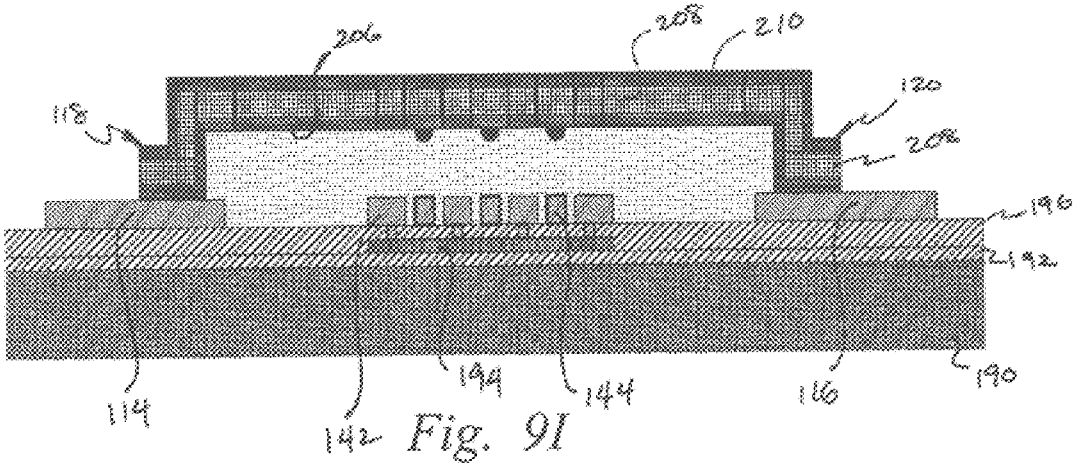
Figure 9J:
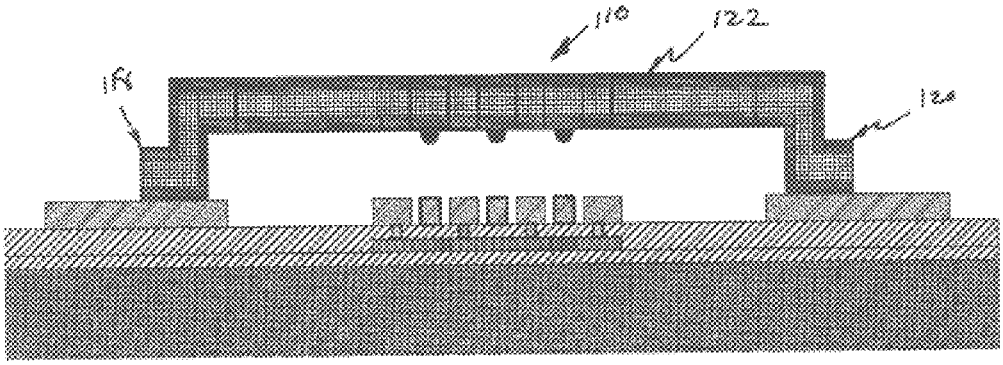

FIGS. 9A through 9J illustrate an embodiment of a process for the construction of a composite beam switch, such as switch 110 (see FIG. 6A). The method for making other embodiments of switches shown herein is an extension of this method. In FIG. 9A, a dielectric material layer 192 such as silicon dioxide ($SiO_2$), silicon nitride (SiN) or silicon carbide (SiC) is deposited on top of another layer 190 such as polysilicon. In FIG. 9B a bottom metal layer is deposited and patterned onto the top of the dielectric layer 192. A low conductivity material, such as polysilicon, is preferred. In FIG. 9C, a second dielectric layer 196 is deposited on top of the first dielectric layer 192 and the bottom metal layer 194, leaving a plurality of holes 198 in the second dielectric layer 196. In FIG. 9D, a conductive layer 200 (e.g., gold) is applied on top of the second dielectric layer and the transmission lines 144 and electrodes 142 are patterned and etched. In FIG. 9E a sacrificial layer 200, which will later be removed to release the beam, is deposited and patterned so that it rests over the area between the dielectric pads 114 and 116. In FIG. 9F, the dimple hole patterns 204 are etched into the sacrificial layer 202 and a liftoff alloying metal, such as titanium (Ti) or nickel (Ni), is deposited into the dimples. In FIG. 9G one of the conductive layers 206 of the beam is deposited on top of the sacrificial layer, the dielectric layer, and the dimples. In FIG. 9H, the structural layer 208 is deposited on top of the first conductive layer 206. In FIG. 9I, the second conductive layer 210 is put on top of the structural layer 208, such that the structural layer 208 is now sandwiched between the first conductive layer 206 and the second conductive layer 210. The resulting structure is etched to create the anchors 118 and 120 and remove unwanted material from the wafer. Finally, in FIG. 9J, the sacrificial layer remaining between the beam 122 and the substrate is removed, such that the beam 122 is released and is ready for operation.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A microelectromechanical (MEMS) switch apparatus comprising:

an anchor attached to a substrate;

an electrically conductive beam attached to the anchor and in electrical contact therewith, the beam comprising:

a tapered portion having a proximal end and a distal end, the proximal end being attached to the anchor, an actuation portion attached to the distal end of the tapered portion, a tip attached to the actuation portion, the tip having a contact dimple thereon; and an actuation electrode attached to the substrate and positioned between the actuation portion and the substrate.

2. The apparatus of claim 1 wherein the tip is attached to the activation portion on the opposite end from where the tapered portion is attached.

3. The apparatus of claim 1 wherein the proximal end of the beam has a greater width than the distal end.

4. The apparatus of claim 1 wherein the beam is comprised of gold (Au).

5. The apparatus of claim 1 wherein the beams are composite beams comprising a plurality of material layers.

6. The apparatus of claim 5 wherein the plurality of layers comprises a structural layer sandwiched between a pair of electrically conductive layers.

7. The apparatus of claim 1 wherein the anchor is connected to ground and the contact dimple contacts a signal line when the actuation electrode is activated.

8. The apparatus of claim 1 wherein the anchor is in electrical contact with a first part of a signal line and the contact dimple can contact a second part of the signal line when the actuation electrode is activated.

9. The apparatus of claim 1 wherein the contact dimple is a first contact dimple, and further comprising a second contact dimple on the tip, wherein the first contact dimple can contact a first part of a signal line and the second contact dimple can contact a second part of the signal line when the actuation electrode is activated.

10. The apparatus of claim 1 wherein the beam is a first beam, and further comprising:

a second anchor attached to the substrate;

a second beam attached to the second anchor and in electrical contact therewith, the second beam comprising:

a tapered portion having a first end and a second end, the first end being attached to the second anchor, an actuation portion attached to the second end of the tapered portion, and a tip attached to the actuation portion, the tip having a contact dimple thereon; and;

a second actuation electrode attached to the substrate and positioned between the actuation portion of the second beam and the substrate.

11. The apparatus of claim 10 wherein the first and second anchors are connected to ground and the contact dimples of the first and second tips can contact a signal line when the first and second actuation electrodes are activated.

12. The apparatus of claim 10 wherein the first anchor is in electrical contact with a first part of a signal line, the second anchor is in electrical contact with a second part of a signal line, and the contact dimple on the tips of the first and second beams can contact a second part of the signal line when the actuation electrode is activated.

13. A microelectromechanical (MEMS) switching apparatus comprising:

a beam array comprising an anchor attached to a substrate and having a plurality of electrically conductive beams connected thereto and in electrical contact therewith, each of the plurality of beams comprising:

a tapered portion having a proximal end and a distal end, the proximal end being attached to the anchor, an actuation portion attached to the distal end of the tapered portion, and a tip attached to the actuation portion, the tip having a contact dimple thereon; and an actuation electrode attached to the substrate and positioned between the substrate and the actuation portion of each beam.

14. The apparatus of claim 13 wherein the tips are attached to the activation portions opposite where the tapered portions are attached.

15. The apparatus of claim 13 wherein the proximal end of each beam has a greater width than the distal end.

16. The apparatus of claim 13 wherein the beams are comprised of gold (Au).

17. The apparatus of claim 13 wherein the beams are composite beams comprising a plurality of material layers.

18. The apparatus of claim 17 wherein the plurality of material layers comprises a structural layer sandwiched between a pair of electrically conductive layers.

19. The apparatus of claim 13 wherein the actuation portion of each beam is joined to the actuation portion of an adjacent beam.

20. The apparatus of claim 13 wherein the anchor is connected to ground and the contact dimples of each beam contact a signal line when the actuation electrode is activated.

21. The apparatus of claim 13 wherein the anchor is in electrical contact with a first part of a signal line and at least one of the contact dimples contacts a second part of the signal line when the actuation electrode is activated.

22. The apparatus of claim 13 wherein the anchor is electrically insulated from the substrate, and wherein the contact dimple of one beam contacts a first part of a signal line and the contact dimple of another beam contacts a second part of a signal line when the actuation electrode is activated.

23. The apparatus of claim 13 wherein the beam array is a first beam array, and further comprising a second beam array comprising:

a second anchor attached to the substrate;

a plurality of electrically conductive beams attached to the second anchor and in electrical contact therewith, each of the plurality of beams comprising:

a tapered portion having a proximal end and a distal end, the proximal end being attached to the anchor, an actuation portion attached to the distal end of the tapered portion, and a tip attached to the actuation portion, the tip having a contact dimple thereon; and an actuation electrode attached to the substrate and positioned between the substrate and the actuation portion of each beam.

24. The apparatus of claim 23 wherein the activation portion of each beam in the second array is joined to the activation portion of an adjacent beam in the second array.

25. The apparatus of claim 23 wherein the first and second anchors are connected to ground and the contact dimples of each beam in the first and second beam arrays can contact a signal line when the first and second actuation electrodes are activated.

26. The apparatus of claim 23 wherein the contact dimples of the first beam array can contact a first portion of a signal line and the contact dimples of the second beam array can contact a second portion of the signal line when the actuation electrodes are activated.

27. A microelectromechanical (MEMS) switch apparatus comprising:

a first anchor and a second anchor, both anchors being attached to a substrate;

an electrically conductive beam attached to the first and second anchors and in electrical contact therewith, the beam comprising:

a first tapered portion having proximal and distal ends, the proximal end being attached to the first anchor, a second tapered portion having proximal and distal ends, the proximal end being attached to the second anchor, and a suspended portion connected to the distal end of the first tapered portion and the distal end of the second tapered portion, the suspended portion comprising an actuation portion and a contact portion, each contact portion having a contact dimple thereon; and an actuation electrode attached to the substrate and positioned between the actuation portion and the substrate.

28. The apparatus of claim 27 wherein the beam has a composite construction.

29. The apparatus of claim 28 wherein the beam comprises a layer of a structural material sandwiched between a pair of layers of an electrically conductive material.

30. The apparatus of claim 27 wherein the beam is made of Gold (Au).

31. The apparatus of claim 27 wherein the suspended portion comprises alternating actuation portions and contact portions.

32. The apparatus of claim 31 wherein the actuation portions are substantially wider than the contact portions.

33. The apparatus of claim 27 wherein the first and second anchors are connected to ground and the contact dimple can contact a signal line when the actuation electrodes are activated.

34. The apparatus of claim 27 wherein the beam is a first beam, and further comprising a second beam adjacent the first beam and attached to the first and second anchors, wherein the second beam has the same construction as the first beam.

35. The apparatus of claim 34 wherein the actuation portion of the first beam is connected to the actuation portion of the second beam.

36. The apparatus of claim 34 wherein the contact dimple of the first beam can contact a first portion of a signal line and the contact dimple of the second beam can contact a second portion of the signal line when the actuation electrode is activated.

37. The apparatus of claim 34 wherein the first and second anchors are connected to ground and the contact dimples on the first and second beams can contact a signal line when the actuation electrodes are activated.

38. A microelectromechanical (MEMS) system comprising:

a signal source;

a signal destination connected to the signal source by a signal line; and a MEMS switch positioned in the signal line, the MEMS switch comprising:

an anchor attached to a substrate;

an electrically conductive beam attached to the anchor and in electrical contact therewith, the beam comprising:

a tapered portion having a proximal end and a distal end, the proximal end being attached to the anchor, an actuation portion attached to the distal end of the tapered portion, a tip attached to the actuation portion, the tip having a contact dimple thereon; and an actuation electrode attached to the substrate and positioned between the actuation portion and the substrate.

39. The system of claim 38 wherein the beam is comprised of gold (Au).

40. The system of claim 38 wherein the beams are composite beams comprising a plurality of material layers.

41. The system of claim 40 wherein the plurality of layers comprises a structural layer sandwiched between a pair of electrically conductive layers.

42. The system of claim 38 wherein the anchor is connected to ground and the contact dimple contacts the signal line when the actuation electrode is activated.

43. The system of claim 38 wherein the anchor is in electrical contact with a first part of the signal line and the contact dimple can contact a second part of the signal line when the actuation electrode is activated.

44. A microelectromechanical (MEMS) system comprising:

a signal source;

a signal destination connected to the signal source by a signal line; and a MEMS switch positioned in the signal line, the MEMS switch comprising:

a first anchor and a second anchor, both anchors being attached to a substrate;

an electrically conductive beam attached to the first and second anchors and in electrical contact therewith, the beam comprising:

a first tapered portion having proximal and distal ends, the proximal end being attached to the first anchor, a second tapered portion having proximal and distal ends, the proximal end being attached to the second anchor, and a suspended portion connected to the distal end of the first tapered portion and the distal end of the second tapered portion, the suspended portion comprising an actuation portion and a contact portion, each contact portion having a contact dimple thereon; and an actuation electrode attached to the substrate and positioned between the actuation portion and the substrate.

45. The system of claim 44 wherein the beam has a composite construction.

46. The system of claim 45 wherein the beam comprises a layer of a structural material sandwiched between a pair of layers of an electrically conductive material.

47. The system of claim 44 wherein the beam is made of Gold (Au).

48. The system of claim 44 wherein the first and second anchors are connected to ground and the contact dimple can contact the signal line when the actuation electrodes are activated.

* * * * *